US006550266B1

(12) United States Patent
Miller

(10) Patent No.: US 6,550,266 B1
(45) Date of Patent: Apr. 22, 2003

(54) MODULAR ICEMAKER CONNECTING DEVICE

(76) Inventor: Dennis G. Miller, 5641 Pt. Milligan Rd., Quincy, FL (US) 32352

( * ) Notice: Subject to any disclaimer, the term of this patent is extended or adjusted under 35 U.S.C. 154(b) by 0 days.

(21) Appl. No.: 10/067,750

(22) Filed: Feb. 8, 2002

(51) Int. Cl.[7] ..... F25C 1/00; F25C 5/09
(52) U.S. Cl. ..... 62/340; 137/355.23; 137/355.26
(58) Field of Search ..... 62/340, 66; 137/355.2, 137/355.16, 355.23, 355.26

(56) References Cited

U.S. PATENT DOCUMENTS 3,788,089 A * 1/1974 Graves ..... 62/137
3,867,957 A * 2/1975 Fehrm ..... 137/360
4,798,061 A * 1/1989 LaConte ..... 62/348
5,381,820 A * 1/1995 Chandler ..... 137/355.23
5,568,824 A * 10/1996 Cordrey ..... 137/355.27
5,678,596 A * 10/1997 Corallo ..... 137/357
5,794,648 A * 8/1998 Jentzsch et al. ..... 137/355.23
6,050,290 A * 4/2000 Yacobi et al. ..... 137/355.2
6,129,109 A * 10/2000 Humber ..... 137/360
6,148,624 A * 11/2000 Bishop et al. ..... 62/137

* cited by examiner

*Primary Examiner*—William E. Tapolcai
*Assistant Examiner*—Mohammad M. Ali
(74) *Attorney, Agent, or Firm*—John Wiley Horton

(57) ABSTRACT

A wall-mounted spool assembly connecting a water line to an icemaker. The icemaker connection is made by a flexible line which is dispensed by an automatically retracting spool. As the refrigerator is moved in and out, the spool dispenses and retracts sufficient line to maintain a stress-free connection to the icemaker. A shut-off valve is incorporated so that the user can shut off the water supply if the refrigerator must be disconnected. The device also included a fascia plate to give the whole a neat and finished appearance.

5 Claims, 6 Drawing Sheets

MODULAR ICEMAKER CONNECTING DEVICE

CROSS-REFERENCES TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field of plumbing. More specifically, the invention comprises an assembly for connecting a refrigerator icemaker to a fixed water line located in a wall, using a self-retracting spool for the connecting line.

2. Description of the Related Art

Most residential refrigerators are equipped with icemakers. These icemakers must be fed by a small water line. FIG. 1 shows a typical prior art installation. A water line 18 is installed within either floor 10 or wall 12. A sufficient length is left exposed to allow flare fitting 20 to be connected to icemaker connector 16 on the back of refrigerator 14 while refrigerator 14 is pulled away from wall 12. Water line 18 is typically ¼ inch copper line. It is somewhat flexible, so that when refrigerator 14 is pulled in and out for maintenance and cleaning it will bend freely. However, those skilled in the art know that over time such copper lines tend to crimp and become fatigued. The mechanical stresses placed on the line will also tend to produce leaks at flare fitting 20. The result is that leaks typically develop in the icemaker water supply.

In addition, the installation of prior art water line 18 is not standardized. The installing plumber must exercise judgment to determine how much excess line will be needed to permit adequate movement of refrigerator 14. Experienced plumbers have little trouble with this issue, but many residential jobs are performed by persons lacking the necessary skills and judgment.

Finally, the prior art installation has an inherently crude appearance that displeases the homeowner. The known devices for connecting icemakers are therefore limited in that they:

1. Are subject to fatigue and resulting leakage;
2. Require an experienced plumber for proper installation; and
3. Have a crude appearance.

BRIEF SUMMARY OF THE INVENTION

The present invention is a modular icemaker connecting device which eliminates the disadvantages inherent in the prior art. Referring to FIG. 2, the invention comprises a wall-mounted spool assembly. The icemaker connection is made by a flexible line which is dispensed by an automatically retracting spool. As the refrigerator is moved in and out, the spool dispenses and retracts sufficient line to maintain a stress-free connection to the icemaker.

A shut-off valve is incorporated so that the user can shut off the water supply if the refrigerator must be disconnected. The device also included a fascia plate to give the whole a neat and finished appearance.

Accordingly, several objects and advantages of the present invention are:

1. to eliminate water line stress and resulting leakage;
2. to provide a modular system which can be installed by relatively inexperienced plumbers; and
3. to provide a neat and finished appearance.

These objects and advantages will be fully explained in the details hereafter described, explained, and claimed, with reference being made to the accompanying drawings.

REFERENCE NUMERALS IN THE DRAWINGS

| | | | |
|---|---|---|---|
| 10 | floor | 12 | wall |
| 14 | refrigerator | 16 | icemaker connector |
| 18 | water line | 20 | flare fitting |
| 22 | stud | 24 | supplemental stud |
| 26 | spool assembly | 28 | chassis |
| 30 | spool | 32 | flex line |
| 34 | mounting tabs | 36 | valve |
| 38 | fascia | 40 | bulkhead |
| 42 | trunnion hole | 44 | bulkhead guide |
| 46 | spring stop | 48 | mounting hole |
| 50 | rotary connector | 52 | flex line connector |
| 54 | constant force spring | 56 | anchor slot |
| 58 | spring recess | 60 | spool connector |
| 62 | inlet hole | 64 | trunnion |

DETAILED DESCRIPTION OF THE INVENTION

Figure 1:
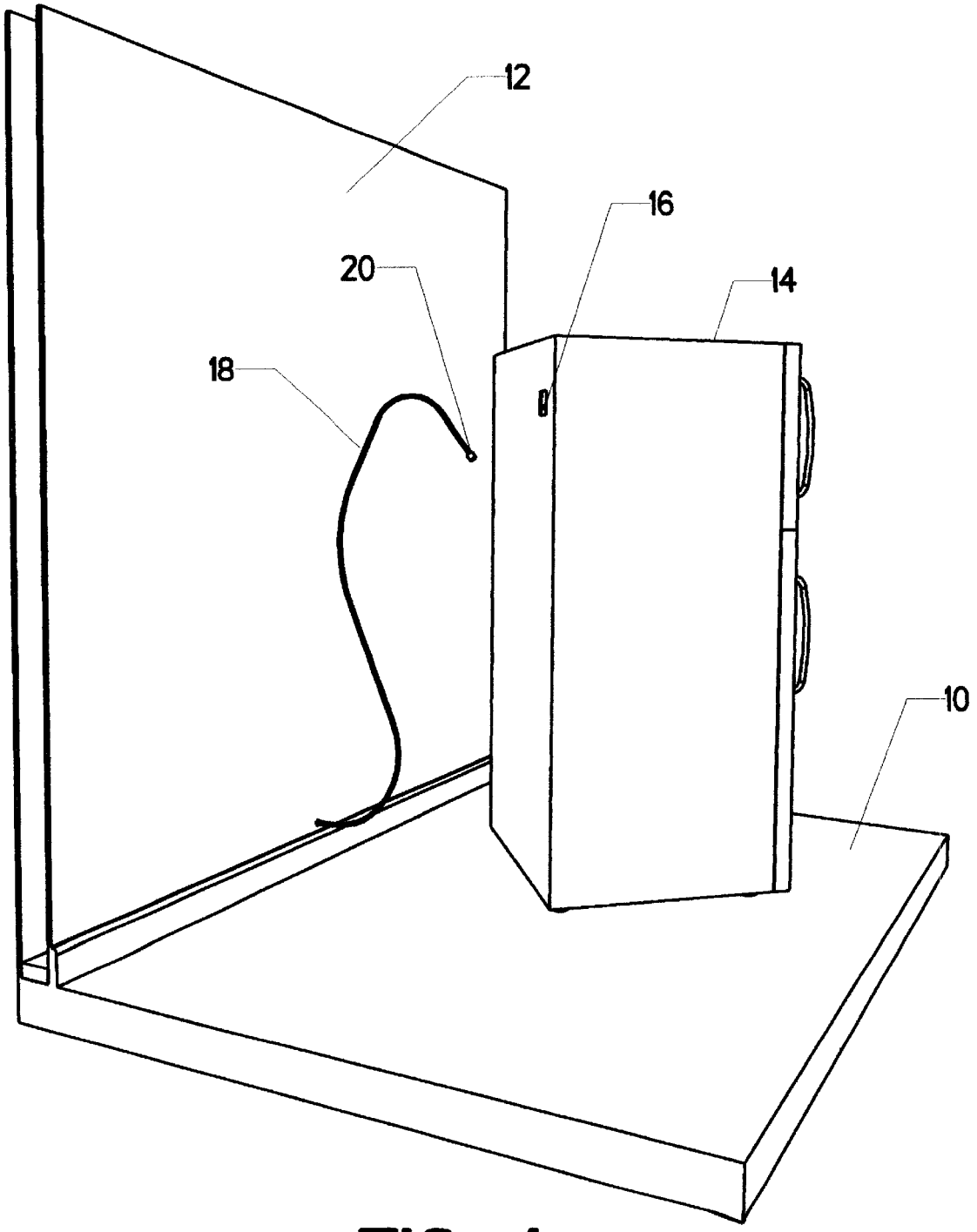
FIG. 1 (PRIOR ART)
FIG. 1 is an isometric view, showing the prior art.
Figure 2:
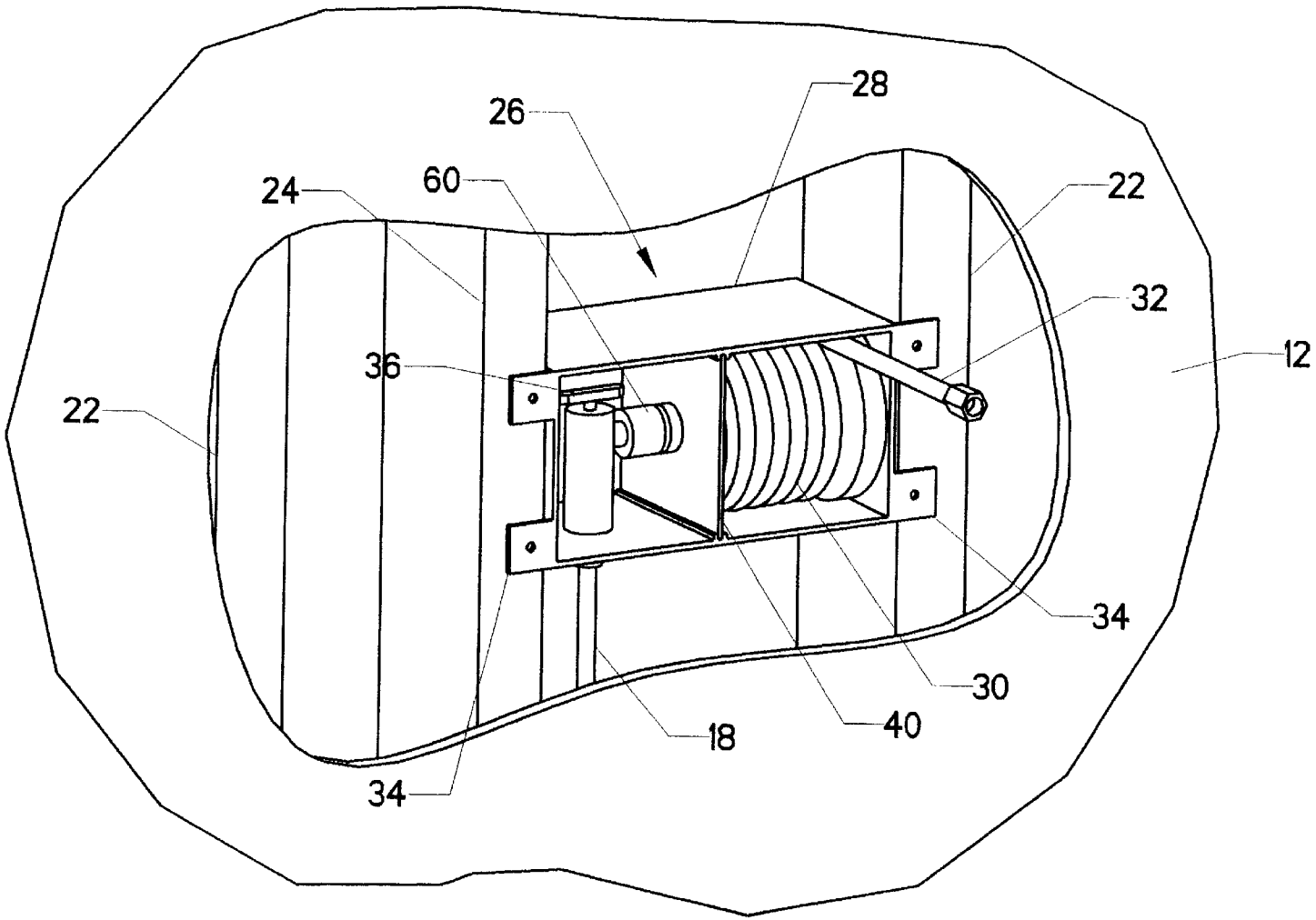
FIG. 2 is an isometric view, showing the device installed in a wall.

The proposed invention will typically be mounted in a wall in the area directly behind a refrigerator (or free-standing icemaker). FIG. 2 shows a portion of wall 12 with a cutaway through the sheetrock to aid visualization. Those skilled in the art will know that a residential wall is typically formed by a series of studs 22 covered by sheets of sheetrock (also known as "drywall"). Residential studs are typically erected on 16 inch centers. The distance between adjoining studs—approximately 14.5 inches—is often too wide to mount the proposed invention. Thus, the inventor recommends placing an intermediate supplemental stud 24, as shown. Chassis 28 is mounted between stud 22 and supplemental stud 24. Four mounting tabs 34 are provided to facilitate the attachment of chassis 28 to the studs. Those skilled in the art will realize that chassis 28 could easily be made 14.5 inches wide, thereby eliminating the need for supplemental stud 24. However, as some construction uses smaller stud-to-stud spacing, this could present a problem. The inventor has therefore learned that it is best to make chassis 28 relatively compact—allowing the framer or plumber to add appropriate supplemental studs during the installation.

The group of components shown in FIG. 2 is denoted generally as spool assembly 26. The reader will observe that chassis 28 is split by bulkhead 40 into two compartments. The right compartment contains spool 30. The left compartment contain valve 36. Valve 36 is connected to water line 18 using a conventional fitting. Valve 36 is then connected to spool 30 by spool connector 60. Water flows into the invention through water line 18. It then flows through valve 36 and through spool connector 60. Spool 30 contains an integral water passage allowing the water to flow from spool connector 60 into spool 30. Flex line 32 is wrapped around spool 30. The first end of flexline 32 is fluidly connected to the integral water passage within spool 30. The second end of flexline 32 is free to be pulled away from spool 30.

A rotary connector between spool connector 60 and spool 30 allows spool 30 to rotate without leaking. Thus, if a user pulls on the free end of flexline 32, flexline 32 will unwrap from spool 30 as spool 30 rotates.

Figure 3:
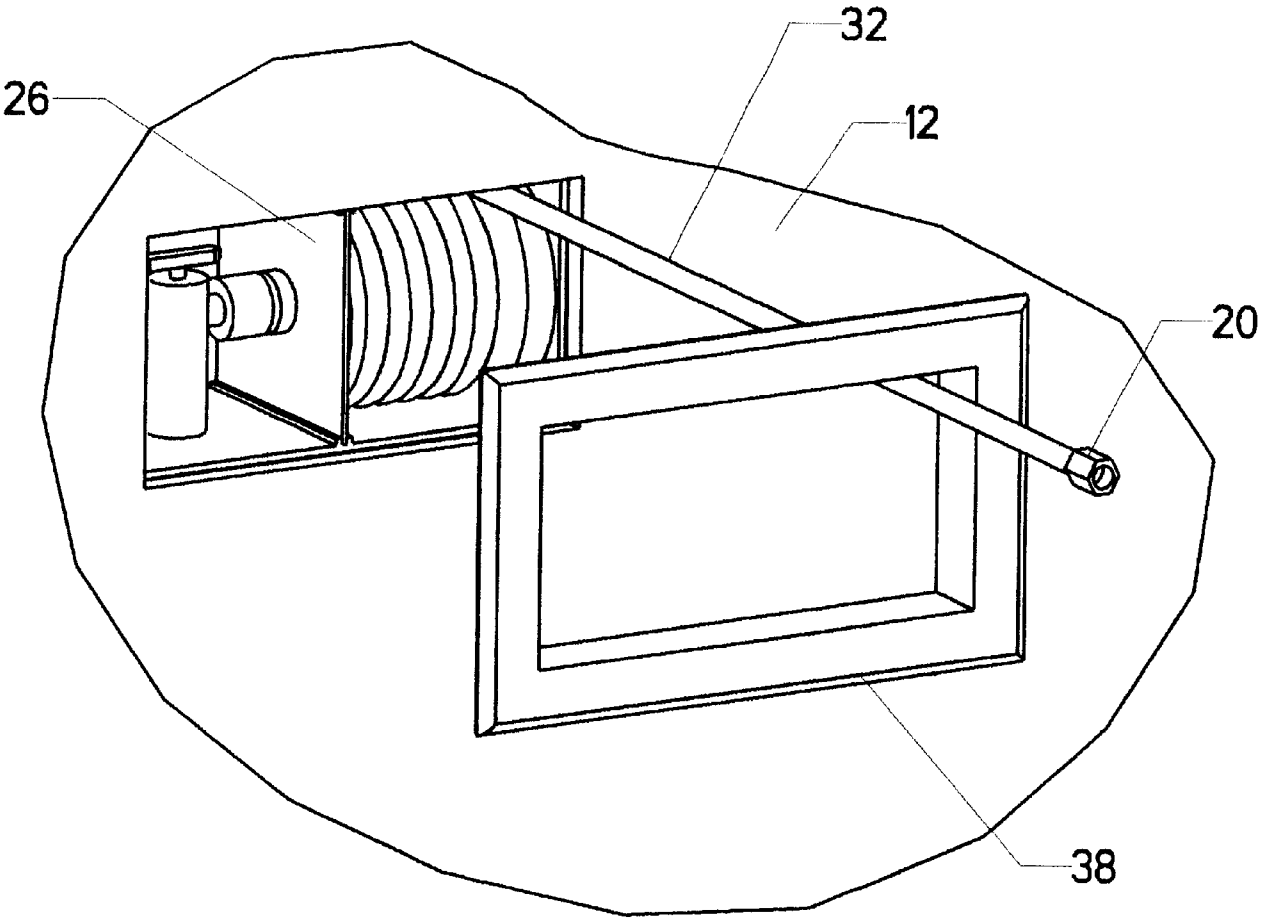
FIG. 3 is an isometric view, showing the operation of the device.

Spool assembly 26 will normally be attached to the studs before the sheetrock is put in place. FIG. 3 shows a completed installation of spool assembly 26 with the drywall in place. The free end of flex line 32 terminates in flare fitting 20, which is adapted to be attached to icemaker connector 16. Once installed, if a user grasps flare fitting 20 it may easily be pulled away from wall 12 to the desired length for attachment to the icemaker.

A rectangular hole must obviously be made in the sheetrock to accommodate spool assembly 26. This hole is often cut by hand, leaving a rough appearance. Fascia 38 is provided to dress the hole. Fascia 38 snaps onto the front of chassis 28, thereby giving the completed installation a neat appearance.

Figure 4:
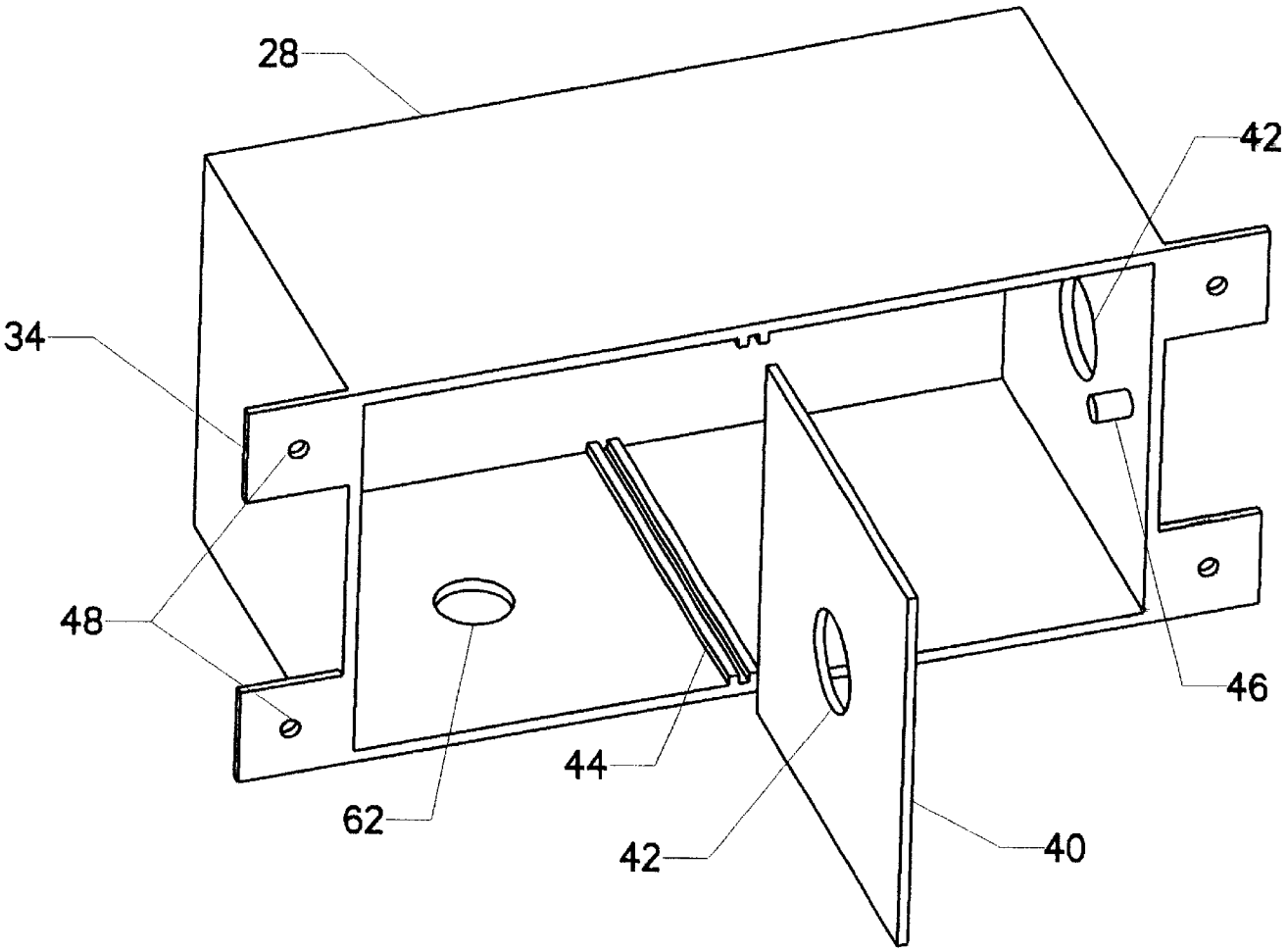
FIG. 4 is an isometric view, showing the chassis.
Figure 5:
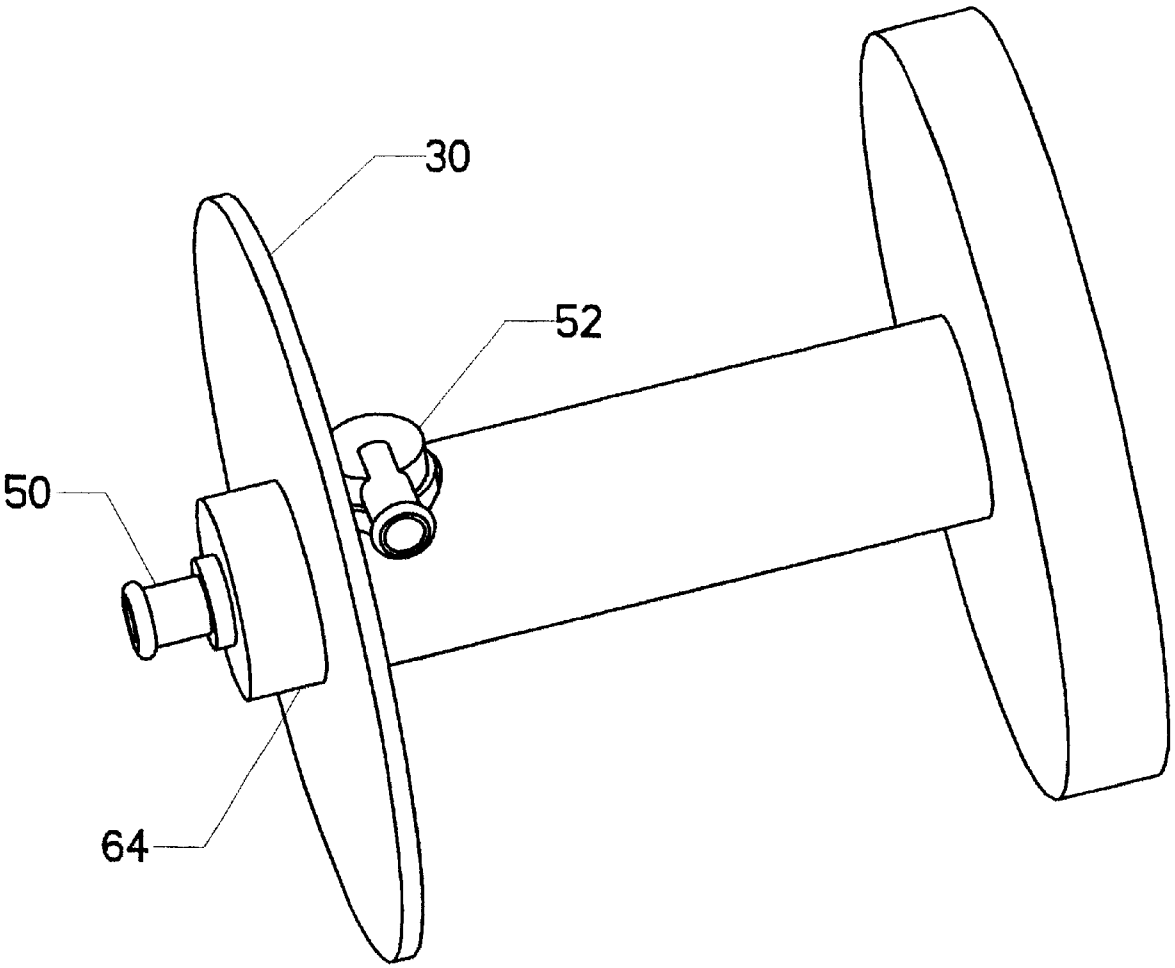
FIG. 5 is an isometric view, showing the spool.
Figure 6:
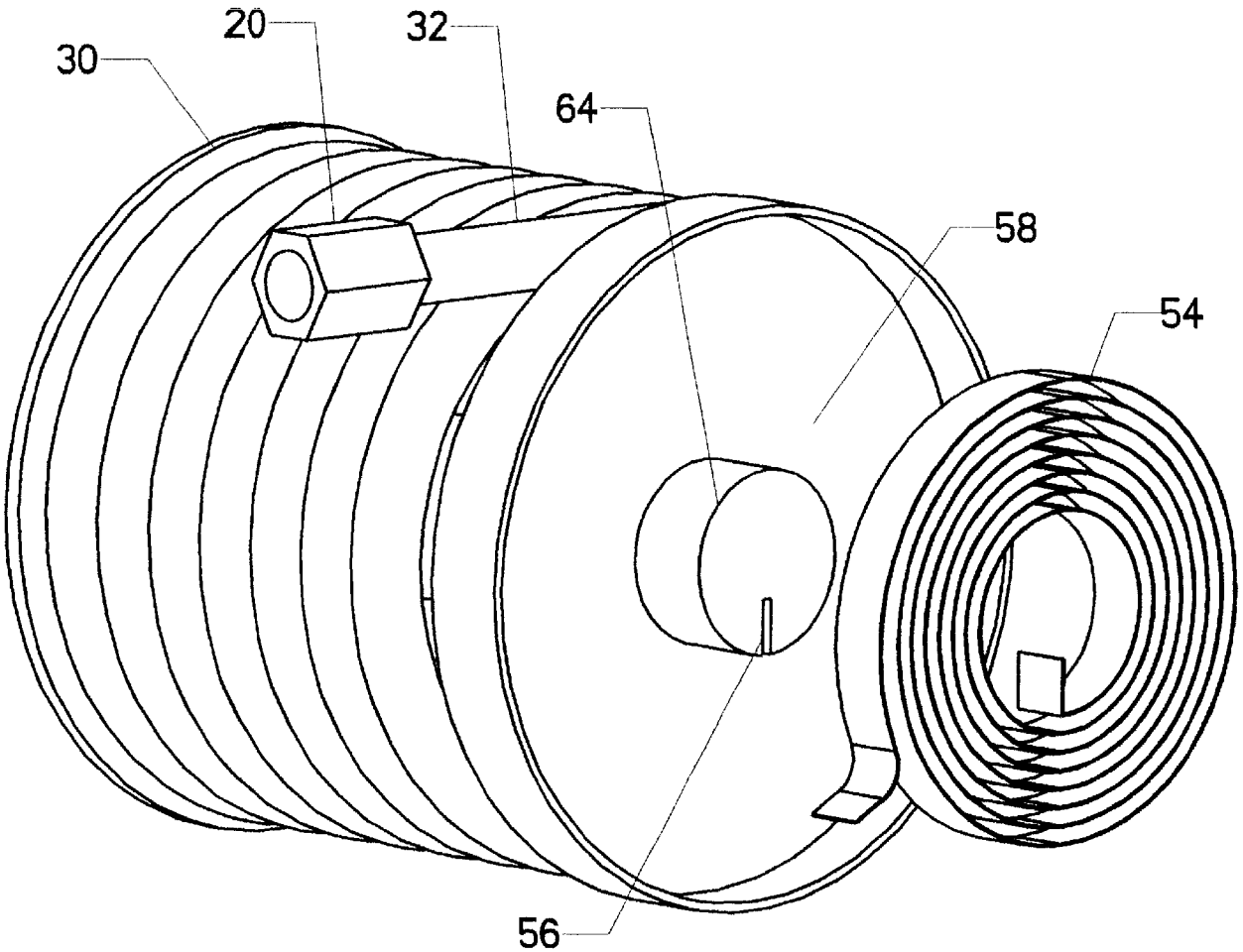
FIG. 6 is an isometric view, showing additional features of the spool.

FIG. 4 shows some details of chassis 28. Bulkhead 40 is ideally made separately to facilitate the mounting of spool 30. It slides into place along bulkhead guides 44. Both bulkhead 40 and the right wall of chassis 28 are pierced by trunnion holes 42. Referring briefly to FIGS. 5 and 6, the reader will observe that each end of spool 30 has a trunnion 64. These fit within trunnion holes 42, allowing spool 30 to freely rotate within chassis 28.

Returning now to FIG. 4, inlet hole 62 is provided to mount valve 36. Typically, a portion of valve 36 will extend below chassis 28, and this portion is connected to water line 18. The user can use valve 36 to shut off the flow of water if desired.

Four mounting tabs 34 are provided for mounting chassis 28 to the wall studs. Each mounting tab 34 is pierced by a mounting hole 48. Nails or screws would typically be driven through mounting holes 48 to secure chassis 28 in place.

FIG. 5 shows spool 30 without flex line 32. At its lefthand extreme is rotary connector 50. Flex line connector 52 is located near the center axis of spool 30. An internal water passage fluidly connects rotary connector 50 with flex line connector 52. Rotary connector 50 is attached to spool connector 60. The portion of rotary connector 50 attached to spool connector 60 remains fixed. However, a second portion of rotary connector 50 is free to rotate with spool 30. Internal gaskets prevent the connector from leaking, despite the rotary motion. As such connectors are well known in the prior art, it will not be described in greater detail.

Flex line 32—as mentioned previously—has two ends. The first end is attached to flex line connector 52. Flex line 32 is then wrapped around spool 30, leaving the second end of flex line 32 free.

FIG. 6 shows spool 30 with flex line 32 wrapped in place, and the second end of flex line 32 (terminating in flare fitting 20) free. If a user pulls on flare fitting 20, flex line 32 will unwrap as spool 30 rotates.

Those skilled in the art will realize that once flex line 32 is completely unwrapped from spool 30 it will be cumbersome to rewrap. Constant force spring 54 is provided to remedy this problem. Constant force spring 54 rests within spring recess 58 in the right side of spool 30. The inner termination of constant force spring 54 locks into anchor slot 56. Returning briefly to FIG. 4, the reader will observe that when spool 30 is mounted within chassis 28, the outer termination of constant force spring 54 will rest against spring stop 46. Returning now to FIG. 6—those skilled in the art will realize that constant force spring 54 will apply a relatively constant torque to spool 30 which tends to wrap flex line 32 back onto spool 30. Thus, in use, a user can easily pull flare fitting 20 away from the wall and connect it to the icemaker when the icemaker (and possibly the accompanying refrigerator) is pulled away from the wall. When the icemaker or refrigerator is pushed back toward the wall, spool 30 will rotate and take up any slack in flex line 32. Thus, the invention automatically extends and retracts flex line 32 as needed to accommodate the position of the icemaker relative to the wall.

Accordingly, the reader will appreciate that the proposed invention can greatly improve the connection of a water line to an icemaker. The invention has further advantages in that it:

1. Eliminates water line stress and resulting leakage;
2. Provides a modular system which can be installed by relatively inexperienced plumbers; and
3. Provides a neat and finished appearance.

Although the preceding description contains significant detail, it should not be construed as limiting the scope of the invention but rather as providing illustrations of the preferred embodiment of the invention. Thus, the scope of the invention should be fixed by the following claims, rather than by the examples given.

Having described my invention, I claim:

1. A modular icemaker connecting device for connecting a water line proximate to a wall to an icemaker, comprising:

a. a chassis, fixedly attachable to said wall;

b. a spool, attached to said chassis, and having an integral fluid passage;

c. a rotary connector, fluidly connecting said integral fluid passage within said spool to said water line so that said spool is free to rotate without leakage; and d. a flex line wrapped around said spool, having a first end attached to said spool in fluid communication with said integral fluid passage, and a second end configured to attach to said icemaker, so that when said flex line is unwrapped from said spool, said second end moves away from said chassis, thereby accommodating motion between said icemaker and said wall.

2. A device as recited in claim 1, further comprising a constant force spring configured to maintain an approximately constant torque on said spool which tends to wrap said flex line around said spool.

3. A device as recited in claim 1, further comprising a valve positioned between said water line and said rotary connector, so that a user can shut off the flow of water into said spool.

4. A device as recited in claim 1, wherein said chassis further comprises at least one mounting tab adapted to allow the mounting of said chassis to a stud within said wall.

5. A device as recited in claim 1, further comprising a detachable fascia.

* * * * *